United States Patent [19]

Kroecher

[11] Patent Number: 4,706,948

[45] Date of Patent: Nov. 17, 1987

[54] CENTERING AND CLAMPING APPARATUS FOR ELONGATE ROUND BODIES OF VARIOUS DIAMETER

[75] Inventor: Harro Kroecher, Bad Kreuznach, Fed. Rep. of Germany

[73] Assignee: Hombak Maschinenfabrik GmbH & Co. KG, Bad Kreuznach, Fed. Rep. of Germany

[21] Appl. No.: 915,111

[22] Filed: Oct. 3, 1986

[30] Foreign Application Priority Data

Oct. 5, 1985 [DE] Fed. Rep. of Germany ..... 3535616

[51] Int. Cl.[4] ..... B25B 1/04

[52] U.S. Cl. ..... 269/34; 269/58; 269/239; 269/225

[58] Field of Search ..... 198/345; 144/245 B; 269/34, 239, 13–14, 56, 58–60, 225; 279/1 L

[56] References Cited

U.S. PATENT DOCUMENTS

| | | | |
|---|---|---|---|
| 774,563 | 11/1904 | Clark | 269/225 |
| 2,786,434 | 3/1957 | Klungtvedt | 269/60 |
| 4,211,394 | 7/1980 | Sampson | 269/239 |
| 4,339,116 | 7/1982 | Benz et al. | 269/225 |
| 4,625,853 | 12/1986 | Gregg | 198/345 |

FOREIGN PATENT DOCUMENTS

| | | | |
|---|---|---|---|
| 246520 | 4/1964 | Austria | 269/34 |
| 12558 | 6/1901 | Sweden | 269/239 |

*Primary Examiner*—Robert C. Watson

*Attorney, Agent, or Firm*—Schwartz, Jeffery, Schwaab, Mack, Blumenthal & Evans

[57] ABSTRACT

The invention relates to an apparatus for the automatic mechanical centering and simultaneous clamping of elongate round bodies of various diameter. It consists of two collet chunks arranged at an axial distance from each other in the plane of symmetry of which lies the centering axis. The two chunk arms of each collet chunk include collet jaws each of which is provided with one slide element and one grip element. The effective flanks of the grip elements are concavely curved such that they in each case engage the circumference of the round bodies when the round bodies, sliding along the effective flanks on the slide elements, have been raised by the latter until their longitudinal axes coincide with the centering axis.

11 Claims, 3 Drawing Figures

CENTERING AND CLAMPING APPARATUS FOR ELONGATE ROUND BODIES OF VARIOUS DIAMETER

BACKGROUND OF THE INVENTION

The invention relates to an apparatus for the automatic mechanical centering and clamping of elongate round bodies of various diameter of wood, metal or plastic, on which processing operations are to be carried out which are oriented to the central longitudinal axes of the round bodies clamped in place. This may concern sizing of the trunk circumference of round timber, or faceworking of the ends or chamfering of the same, for example on pipe ends to prepare for welds.

A specific example of such processing is the circular milling of the root ends of tree trunks, to obtain sized round timbers for their trouble-free further processing. Such an apparatus for the milling off of root swellings on tree trunks is described in German Offenlegungsschrift No. 33 06 569, in which the tree trunk, clamped in place, has a milling tool circling around its root end. The tree trunk is supported on two support bearings arranged axially one behind the other and is clamped against rotation during a milling-off by a hold-down device acting from above. In order to ensure that the central longitudinal axes of tree trunks which vary in their diameters are always aligned with the circling axis of the milling tool, the two support bearings have a V-shaped bearing profile symmetrical to the vertical centering plane, and the bearings are also vertically adjustable. While alignment of the tree trunks in the vertical centering plane, in other words in horizontal direction, by the V-shaped bearing profile of the two support bearings is performed more or less automatically, for alignment in the horizontal centering plane the two support bearings have to be adjusted vertically. This may be carried out visually by simple eye judgement or, with a correspondingly more complex apparatus, by optoelectrical measuring equipment. Only when a tree trunk has its longitudinal axis aligned to and centered with the circulating axis of the milling tool can it be clamped against rotation by the hold-down device acting from above. This known centering and clamping arrangement for tree trunks therefore requires relatively expensive apparatus and is time consuming. In addition, it often does not satisfy the required accuracy.

In the case of centering apparatuses for veneer peeling machines, it is already known from German Patent No. 11 72 028 to center round timbers automatically and mechanically, without special measuring facilities. This is effected in principle in the case of the centering apparatus described there by three centering levers each of which is pivoted by a common drive, in the manner of an iris diaphragm, synchronously inward into the mouth-shaped opening of two jaw arrangements arranged at an axial distance from each other. Apart from the fact that no clamping against rotation of the round timbers is required in the case of this known centering apparatus specifically intended for veneer peeling machines, a considerable disadvantage of this known centering device is to be seen above all in the fact that the construction expenditure for the synchronous pivoting of the three centering levers is very great. For instance, apart from the three centering levers with their three pivot axes, two further control levers with additional four joints are required, which not only involves great manufacturing expense but is also susceptible to operational faults.

SUMMARY OF THE INVENTION

The invention therefore has the purpose of substantially simplifying the centering of round bodies with simultaneous improvement of accuracy, and combining this with the clamping in place of the round bodies in one operation.

The invention is based on the object of not only considerably reducing the construction expense for the automatic centering of various round bodies, but ensuring at the same time the clamping against rotation of the round bodies.

The centering apparatus comprises a collet chuck the design of which not only makes possible a quick and exact centering of the round bodies economically and operationally, but ensures at the same time their clamping against rotation. Since the centering axis lies in the plane of symmetry of the collet chuck, the round bodies are already aligned in relation to the vertical centering plane when they are placed in the centering apparatus. Their alignment to the horizontal centering plane is performed during the closing movement of the collet chuck as a result of relative sliding of the round bodies on the slide elements of the two chuck arms, the round bodies being pushed upward as a result of the scissor-like reduction of the opening angle formed by the two slide elements. The effective flanks of the grip elements of the two chuck arms are, according to the invention, concavely shaped such that they engage the circumference of a round body at the moment in which the latter is raised by the slide elements just enough so that its central longitudinal axis aligns with the centering axis. Engagement of the grip elements on the round body causes the closing movement of the collet chuck, and thus also the lifting movement of the round body, to stop. From this moment on, the entire drive force of the collet chuck is available exclusively for the clamping against rotation of the round body. Since usually two collet chucks are arranged at an axial distance from each other, and the centering is performed by each collet chuck independently of the respective diameter, conical round bodies, as is the case for example with tree trunks, are also exactly centered in their longitudinal axis.

As explained in more detail below, the concave curvature of the effective flanks of the grip elements can be determined in a simple way if, in the clamped state of the round bodies, the bearing points on the slide elements are assigned the engagement points on the grip elements in such a way that the associated tangents are perpendicular to each other.

BRIEF DESCRIPTION OF THE APPLICATION DRAWINGS

The invention as described below is exemplified in a butt log reducer, and is illustrated in the application drawings, in which.

DETAILED DESCRIPTION OF THE PREFERRED EMBODIMENTS

Figure 1:
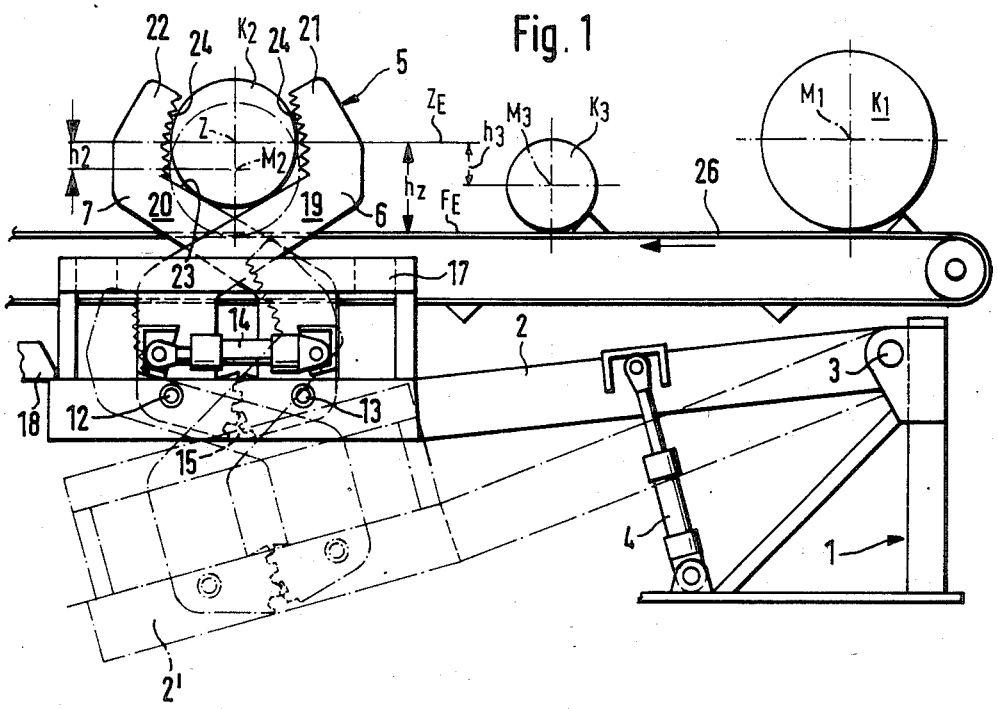
FIG. 1 shows the overall view of the centering and clamping apparatus.

FIG. 1 shows only one of the two centering and clamping apparatuses arranged at an axial distance. Since both are identical, only one of them is described in detail below.

On a base frame 1 is pivotably mounted a carrying beam 2 by means of an axis 3 such that the carrying beam can be lowered into the position shown in broken lines. Hinged to the carrying beam 2 is the piston rod of a hydraulic cylinder-piston unit 4, the cylinder of which is supported on the base frame 1. Mounted in the region of the free end of the carrying beam 2 is the actual centering apparatus, which is designed according to the invention as collet chuck 5.

The collet chuck 5 includes two chuck arms 6 and 7, each of which includes actuation parts 10 and 11, respectively, and function parts 8 and 9, in the form of collet jaws. The two chuck arms 6 and 7 are pivotably mounted by their actuation parts 10, 11 on axes 12 and 13, respectively, attached to the carrying beam 2.

The drive mechanism of the collet chuck 5 consists of a hydraulic cylinder-piston unit 14, which engages in hinged manner with the actuation parts 10, 11 of the two chuck arms 6, 7 above their pivot axes 12, 13. Each of the actuation parts 10, 11 of the two chuck arms 6, 7 is provided with a tooth segment 16, in alignment with the pivot axes 12, 13. The tooth segments 16 form a synchronizing gear 15 which ensures a uniform movement of the two chuck arms 6, 7. For the axial stabilization of both sides of the two chuck arms 6, 7, a guide frame 17 is secured on the carrying beam 2, with the chuck arms 6, 7 being guided in a sliding manner in the region of their actuation parts 10, 11. A fixed stop 18 limits the upward pivotal movement of the carrying beam 2 and holds it firm during the processing operation, under the effect of the hydraulic cylinder-piston unit 4, in the working position of the collet chuck 5.

The collet jaws 8, 9 of the two chuck arms 6, 7 consist of slide elements 19 and 20, grip elements 21 and 22, respectively. The effective flanks 23 of the slide elements 19, 20 run rectilinearly, while the effective flanks 24 of the grip elements 21, 22 are curved concavely and provided with teeth 25. A horizontally-running conveying device 26 provides for the supply and removal of the round bodies $K_1$, $K_2$, $K_3$ transversely to the centering axis Z of the apparatus.

Figure 2:
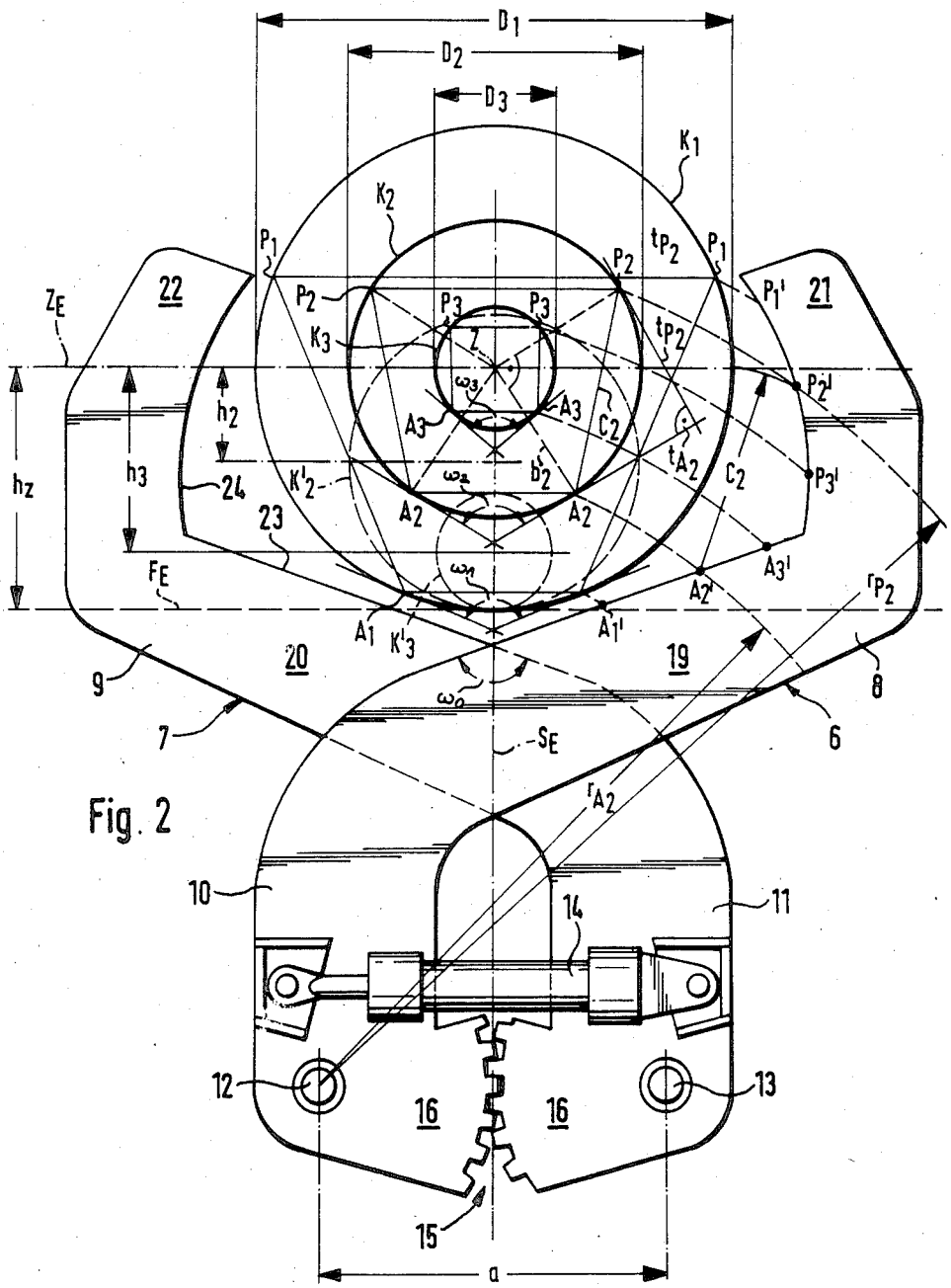
FIG. 2 shows the chuck geometry of a collet chuck.

FIG. 2 illustrates the tooth geometry of a chuck collet 5. Three concentric circles around the centering axis Z as the central point symbolize the circumference of three round bodies $K_1$, $K_2$, $K_3$ having diameters $D_1$, $D_2$, $D_3$, respectively. The round bodies are located in each case in the clamped state, in which their central longitudinal axes $M_1$, $M_2$, $M_3$ coincide with the centering axis Z, which for its part represents the line of intersection of the horizontal-centering plane ZE (FIG. 1) with the vertical plane of symmetry SE (FIG. 2) of the collet chuck 5. The horizontal centering plane ZE has a vertical difference $h_z$ (FIG. 1) with respect to the conveying plane FE. The round bodies $K_1$, $K_2$, $K_3$ lie with their circumference on the conveying plane FE during their supply and removal conveyance as is indicated in FIG. 2 for the round bodies $K_2$ and $K_3$ by broken circles $K_2'$ and $K_3'$. The vertical differences between their central longitudinal axes $M_2$ and $M_3$ (FIG. 1) on the one hand, and the centering axis Z on the other hand, are $h_2$ and $h_3$ (FIG. 1), by which amounts they have to be raised during the centering operation. Since, in the conveyance state, the longitudinal axis of the round body $K_1$ already lies in the horizontal centering plane ZE, this represents the round body with the largest possible centerable diameter $D_1$.

The collet chuck 5 is represented in FIG. 2 in its initial open position, as is the case at the beginning of each centering operation. In this case, the effective flanks 23 of the slide elements 19, 20 form the opening angle $\omega_0$. Actuation of the cylinder-piston unit 14 causes the collet jaws 8, 9 of the two chuck arms 6, 7 to move toward each other in the closing direction, the intermeshing tooth segments 16 effecting a synchronous movement of the two chuck arms 6, 7. The closing movement of the chuck arms 6,7 is ended as soon as the effective flanks 24 of the two grip elements 21, 22 engage the round body $K_1$ at the pair of points $P_1$. This happens in the same moment at which the effective flanks 23 of the slide elements 19, 20 come into contact at the pair of points $A_1$ in the lower region of the round body $K_1$. At the same time, the opening angle formed by the two slide elements 19, 20 is reduced to $\omega_1$. Since FIG. 2 and the above description concern the round body $K_1$ with the largest possible diameter $D_1$, which is aligned with the horizontal centering plane ZE, during the closing movement of the collet chuck 5 there is only an alignment to its vertical plane of symmetry SE.

Round bodies frequently have a smaller diameter than the maximum centerable diameter $D_1$, and they must also be aligned with the horizontal centering plane ZE, as shown in FIG. 2 for the round bodies $K_2$ and $K_3$. In this case, their central longitudinal axes $M_2$ and $M_3$ (FIG. 1) must be raised by the vertical amount $h_2$ or $h_3$ (FIG. 2), which is performed by sliding of the round bodies $K_2$ and $K_3$ on the effective flanks 23 of the slide elements 19, 20 which close like scissors. As soon as the longitudinal axis $M_2$ or $M_3$ coincides with the centering axis Z, the effective flanks 24 of the two grip elements 21, 22 engage the round body $K_2$ or $K_3$ at the pairs of points $P_2$ or $P_3$ (FIG. 2). The opening angle of the two slide elements 19, 20 has at the same time been reduced to $\omega_2$ or $\omega_3$.

The functionally appropriate engagement of the grip elements 21, 22 on the circumference of the round bodies K is conditional on their effective flanks 24 having a defined concave curvature. As demonstrated in detail in FIG. 2 for the round body $K_2$, this concave curve may be constructed in a simple way if the engagement points P of the grip elements 21, 22 are assigned to the bearing points A on the slide elements 19, 20 in the clamped state in such a way that the tangents $t_P$ and $t_A$ which pass through the points P and A are perpendicular to each other. The joining lines between the points A and P, representing sides of an equilateral trapezoid, then form the diagonals c of squares, the side lengths b of which are equal to half the diameter D of the respective round body K, according to the laws of elementary geometry, their lengths in each case therefore being $D/2\times\sqrt{2}$.

The curve point ''' assigned to a certain round body diameter D of a functionally appropriate concave curvature of the effective flank 24 of a grip element 21 is then obtained in the following way: the bearing point A, determined in the clamped state, of the round body K on the effective flank 23 of the slide element 19 is projected by means of a circular arc of radius $r_A$ described about the pivot axis 12 of the chuck arm 8 onto the effective flank 23 of the slide element 19 in opened starting position, thus obtaining the point A' there. The required curve point P' then lies at the intersection of the circular arc described about the pivot axis 12, of radius $r_P$, with the circular arc described about the point A', of radius $c=D/2\times\sqrt{2}$. This curve construction demonstrated in FIG. 2 only for the round body $K_2$ can be carried out for as many diameters as desired, and thus the curve shape constructed to any desired accuracy.

Since a complete centering apparatus consists of two collet chucks 5 arranged at an axial distance from each other, in the clamped state of the round bodies K, all joining lines between the bearing points A and the engagement points P form clamping prisms. The base areas of the prisms lie in the axial-perpendicular clamping planes and are equilateral trapezoids, in the center of which, which is equidistant from the four corner points, runs the centering axis Z.

Furthermore, the joining lines of points A and P to each other and to the centering axis Z produce two equilateral right-angled triangles, the hypotenuses c of which at the same time form the two sides of the equilateral trapezoids, and the length of which is as already described: $D/2\times\sqrt{2}$.

Figure 3:
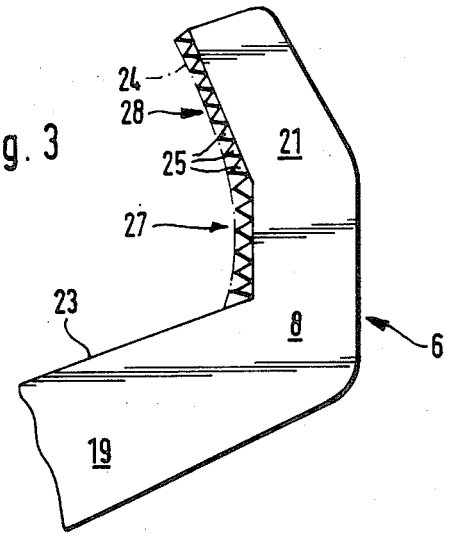
FIG. 3 shows details on the grip element of a chuck arm.

In FIG. 3 is represented the collet jaw 8 of a chuck arm 6, the concave curvature of the effective flank of the grip element 21 being approximated by two rectilinear toothed rack sections 27 and 28. A curved profile approximated in such a way is advantageous in cases where, on the one hand, the round bodies are not exactly circular and, on the other hand, they consist of a relatively soft material, which is often true for example in the case of tree trunks.

The centering and clamping apparatus described operates as follows:

For loading the apparatus with a round body K, for example, a tree trunk, the two carrying beams 2, arranged at an axial distance and having mounted thereon the collet chucks 5, are pivoted downward into the position 2' shown in broken lines in FIG. 1. The collet chucks 5 are then in the opened starting position. Once the conveying device 26 has transported a round body K in the region of the collet chucks 5, the carrying beams 2 are pivoted upward by their cylinder-piston units 4 until they make contact with the fixed stops 18. The collet chucks 5 are then in their working position and are held firm in this position by the cylinder-piston units 4. Thereafter, the closing movement of the two collet chucks 5 is initiated by actuation of the cylinder-piston units 14. At the same time, the round body K slides relative to the effective flanks 23 of the slide elements 19, 20 and is thereby raised as a result of the scissor-like closing movement until its central longitudinal axis M coincides with the central axis Z, which corresponds to the rotation axis of a processing tool, for example a circular miller. At this moment, the effective flanks 24 of the grip elements 21, 22 engage the circumference of the round body K and thereby stop the closing movements of the collet chucks 5, the entire compressive force of the cylinder-piston units 14 then being used for holding the round body against rotation.

In this way minimum expenditure of work and time is involved in exactly centering the round body with respect to the rotation axis of the processing tool and at the same time clamping it absolutely fixed against rotation for the processing operation. After completion of the processing of the round body, the two collet chucks 5 are opened again by actuation of the cylinder-piston units 14, and the carrying beams 2 are again pivoted downward to their position 2' shown in broken lines. The conveying device 26, now set in operation again, then removes the processed round body from the centering and clamping apparatus and at the same time supplies a further unprocessed round body to the apparatus.

What is claimed is:

1. The centering and clamping apparatus for the automatic centering of elongated round bodies, such as round timbers, with the centering axis of processing machines, said apparatus having a plane of symmetry and comprising:

(a) chuck arms which cross to form a scissors-like structure;

(b) means for pivotally mounting said chuck arms at the bottom thereof, and means for synchronously pivoting said arms for clamping and releasing of such round body;

(c) each chuck arm including a collet jaw comprised of a lower slide element and an upper grip element having an effective flank, each flank being concavely curved to permit the flank to engage and clamp the circumference of the round body at bearing points; and (d) means for raising and lowering said mounting means for said chuck arms to permit loading and unloading of the round body, and wherein (e) the concave shape of the effective flanks have such a defined curvature that the grip elements of said chuck arms engage the circumference of the round body at the instant when said round body is moved upwardly along said slide elements until the longitudinal axis of said body coincides with the centering axis of said processing machine.

2. The centering and clamping apparatus as claimed in claim 1, wherein, when the round body is clamped, the bearing points on the effective flanks of the slide elements are assigned engagement points on the concavely curved flanks of the grip elements such that the base areas of clamping prisms formed by the joining lines between the pairs of bearing points and pairs of engagement points are equilateral trapezoids, the center points of which are equidistant from the four pairs of corner points and lie in said centering axis, the sides of the trapezoids each forming the hypotenuses of two equilateral, right-angled triangles.

3. The centering and clamping apparatus as claimed in claim 1, wherein said chuck arms have pivot axes arranged at a distance from each other and symmetrical to the plane of symmetry of the apparatus, and wherein said chuck arms are connected to each other by means of a synchronizing gear.

4. The centering and clamping apparatus as claimed in claim 3, wherein said synchronizing gear consists of two intermeshing tooth segments, each of which is provided attached on an actuation part adjacent the bottom of said chuck arms, said segments being in horizontal alignment with the pivot axes of said chuck arms.

5. The centering and clamping apparatus as claimed in claim 3, wherein the means for pivoting said chuck arms comprises a cylinder-piston unit, operatively engaged with said chuck arms above the pivot axes of said arms.

6. The centering and clamping apparatus as claimed in claim 3, wherein the distance between each of the two pivot axes of the chuck arms is approximately two-thirds of the largest possible diameter of a round body.

7. The centering and clamping apparatus as claimed in claim 1, further including a guide frame in which said chuck arms are guided adjacent the bottom thereof in a sliding manner.

8. The centering and clamping apparatus as claimed in claim 1, wherein said concavely curved effective flanks of said grip elements are provided with teeth.

9. The centering and clamping apparatus as claimed in claim 8, wherein the concave curvature of the effective flanks of the grip elements is approximated by at least two straight toothed racked sections.

10. The centering and clamping apparatus as claimed in claim 1, wherein the effective flanks of the slide elements are rectilinear.

11. The centering and clamping apparatus as claimed in claim 1, further including means for feeding the round bodies in a direction transverse to the centering axis of the apparatus, and wherein said means for pivotally mounting said chuck arms comprise a carrying beam pivotally mounted on an axis parallel to the centering axis of the machine.

* * * * *